US006453121B2

(12) United States Patent
Choi

(10) Patent No.: US 6,453,121 B2
(45) Date of Patent: Sep. 17, 2002

(54) RADIANT HEATER WITH SUBSIDIARY REFLECTING PLATE ADJACENT HALOGEN LAMP

(75) Inventor: Gun-Young Choi, Incheo (KR)

(73) Assignee: VIC Tech Co., Ltd., Incheon (KR)

( * ) Notice: Subject to any disclaimer, the term of this patent is extended or adjusted under 35 U.S.C. 154(b) by 0 days.

(21) Appl. No.: 09/759,001

(22) Filed: Jan. 11, 2001

(30) Foreign Application Priority Data

Jul. 10, 2000 (KR) ..... 00-39383

(51) Int. Cl.[7] ..... F24H 3/00; F24D 13/00
(52) U.S. Cl. ..... 392/376; 392/373
(58) Field of Search ..... 392/375–377, 392/365–369, 409–410

(56) References Cited

U.S. PATENT DOCUMENTS 6,188,836 B1 * 2/2001 Glucksman et al. ..... 392/376
6,205,677 B1 * 3/2001 Yune ..... 34/266

FOREIGN PATENT DOCUMENTS

| | | | |
|---|---|---|---|
| DE | 382099 | * | 9/1923 |
| DE | 820732 | * | 11/1951 |
| DE | 2950001 | * | 6/1981 |
| EP | 577196 | * | 1/1994 |
| FR | 1230451 | * | 9/1960 |
| WO | 9103915 | * | 3/1991 |
| WO | 00/00055 | * | 1/2000 |

* cited by examiner

*Primary Examiner*—John A. Jeffery
(74) *Attorney, Agent, or Firm*—Sheridan Ross PC

(57) ABSTRACT

An electric heater is provided having a heat source mounted in a reflecting plate, a safety cage at the front surface of the reflecting plate, a halogen lamp fixing plate to which a halogen lamp is fixed horizontally, another reflecting plate at a position corresponding to a central curved portion of the halogen lamp to reflect heat to the reflecting plate, and a fixing member between the subsidiary reflecting plate and the center of the safety cage to fix the positions of the plate relative to the lamp.

1 Claim, 5 Drawing Sheets

RADIANT HEATER WITH SUBSIDIARY REFLECTING PLATE ADJACENT HALOGEN LAMP

BACKGROUND OF THE INVENTION

1. Field of the Invention

The present invention relates to an electric heater, and more particularly, to an electric heater in which a halogen lamp is mounted in a reflecting plate, and a subsidiary reflecting plate is provided at the front of the halogen lamp, whereby efficiency of heat reflection can be enhanced and durability can be increased.

2. Description of the Prior Art

With the improvement in living standard, electric heaters have widely been used as an indoor heating apparatus instead of the previous oil heaters. In accordance with the increasing demand for the electric heater, various types of electric heaters have been developed.

As is well known, the basic principle of electric heater is to heat the surrounding air with the heat generated by supplying electric current for the heating wires which are protected by a safety cage disposed with a certain space. In addition, the electric heater is provided by appurtenants for effectively irradiating the heat generated from the heating wires. As a typical example thereof, an electric heater in which a reflecting plate prepared by bending a rectangular shaped thin metal sheet is disposed in a rear portion of heating wires has been pervaded, but a satisfactory effectiveness could not be obtained. In the electric heater as described above, there was a problem that heat cannot be transferred to the desired point in the distance. In fact, if electric current of the heater is increased in order to deliver sufficient heat, dangers of overheat and fire may be accompanied. On the contrary, if the current is decreased in order to avoid any possible accidents, it is difficult to obtain a satisfactory heating effect.

In order to solve the problem involved in the above conventional heater, Korean Utility Model Laid-Open Publication No. 98-61527 discloses an improved radiant type heater which can transfer an appropriate amount of heat to the desired point in the distance so that the indoor air can sufficiently be warmed. In such a radiant type heater, a spherical reflecting plate is installed at the rear portion of heating wires, and the diameter of a wire mounting portion is gradually decreased toward the rear portion so that heat is not scattered into all directions but concentrated in narrow range, whereby heat can be transferred to the desired point in the distance.

Specifically, referring to FIGS. 1 and 2, the prior art electric heater 1 is divided into a heating part 10 including a heating wire 12 and a supporting part 20. At first, in the supporting part 20, a main circuit for operating and controlling radiant type heater is installed in a supporting anvil 21. Also, a power switch 22 for supplying or breaking electric power, a temperature controlling switch 23 for controlling electric power on the basis of a specific temperature in order to maintain temperature of the heating wire in appropriate range, a power display lamp 24 for displaying as to whether electric power is supplied or not, a safety switch 29 for controlling electric power according to the tilt of the electric heater and an alarm lamp 25 for showing a signal to user when the electric heater is tilted extremely, etc., are disposed in the lower and the upper portions of the supporting anvil 21.

In addition, the heating part 10 and the supporting anvil 21 are connected with each other via a first supporting post 26 and a second supporting post 27. If a control knob 28 is released, the second supporting post 27 can be put into or extracted from the first supporting post 26. That is, overall height of the heater can be adjusted.

With reference to FIG. 2 showing the enlarged heating part of the radiant type heater according to the prior art, the heating part 10 comprises a heating wire 12 which is wound round a wire mounting portion 11 having a certain shape, a reflecting plate 13 which is disposed in the rear portion of the heating wires, a safety cage 14 which is connected to the reflecting plate and forms a compartment of the front part of the overall heating part 10, and a supporting case 15 which is connected to the rear part of the reflecting plate 13. On the other hand, the heating wire 12 is connected to the reflecting plate 13 by means of a bracket 16, and a plurality of heating sensing rods 17 are fixed to the front end of the reflecting plate. Therefore, the heat rays a emitted from the heating wire 12 is concentrated into a certain range C by the reflecting plate 13, unlike the structure in which heat is scattered into all directions. Consequently, the heat can be reached to the desired position in the distance. The heat rays a are not stagnated around the heating portion 10 including the heating wire but radiated through the reflection process via the reflecting plate to prevent overheat of the safety cage 14. Here, the maximum heat ray convergence effect can be achieved in a case where the reflecting plate 13 has a concave shape; that is, the central portion of the reflecting plate is concave including a spherical surface such as a conventional concave mirror.

Meanwhile, the wire mounting portion 11 around which the heating wire 12 is wound is prepared from a heat-resistant material such as ceramics and has a circular cone shape, and the diameter of the wire mounting portion 11 is gradually decreased toward the rear portion so that all heat rays a generated from the heating wire 12 are directed to the reflecting plate 13 to prevent some of the heat rays from scattering out of a certain range C. An object of the invention can be achieved although the shape of the wire mounting portion 11 is neither a circular corn, a triangle nor polygonal horn. In other words, it is possible to use all shapes of the wire mounting portion 11 having a diameter which is gradually decreased toward the rear end.

It is true that the electric heater with the structure as described above has a superior heat efficiency. However, since the heating wire is formed in a coil shape, the heating coil of the heater is corroded if the heater is used for a long time which provokes problems that durability is low and there is a danger of fire.

SUMMARY OF THE INVENTION

Therefore, an object of the present invention is to provide an electric heater which can overcome the prior art problems, and which utilizes a halogen lamp and a subsidiary reflecting plate which is disposed at the front portion of a halogen lamp so that reflection efficiency and durability can be improved.

To achieve this object, the heater according to the present invention was constructed so that a halogen lamp is used as a heating means, and a reflecting plate is disposed in the front portion of the halogen lamp and is fixed to a safety cage.

BRIEF DESCRIPTION OF THE DRAWINGS

For complete understanding of the nature and objects of the invention, reference should be made to the following detailed description taken in conjunction with the accompanying drawings in which.

DETAILED DESCRIPTION OF THE INVENTION

The present invention provides an electric heater which comprises a heating means mounted in a reflecting plate, a safety cage disposed at the front surface of the reflecting plate, a halogen lamp fixing plate having fixing holes to which a halogen lamp is fixed horizontally, a subsidiary reflecting plate disposed at a position corresponding to a curved central portion of the halogen lamp to reflect heat to the reflecting plate, and a fixing member interposed between the subsidiary reflecting plate and the center of the safety cage to fix the positions of the plate and the cage.

Hereinafter, the present invention will be illustrated in more detail with reference to the attached drawing figures.

Figure 1:
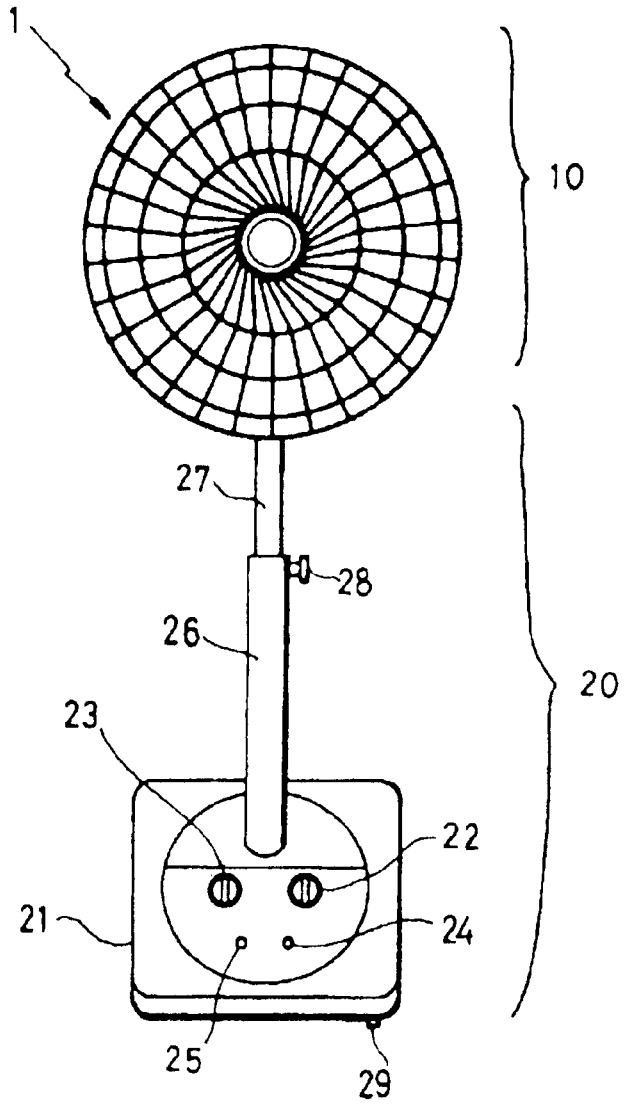
FIG. 1 is a front view of the conventional electric heater.
Figure 2:
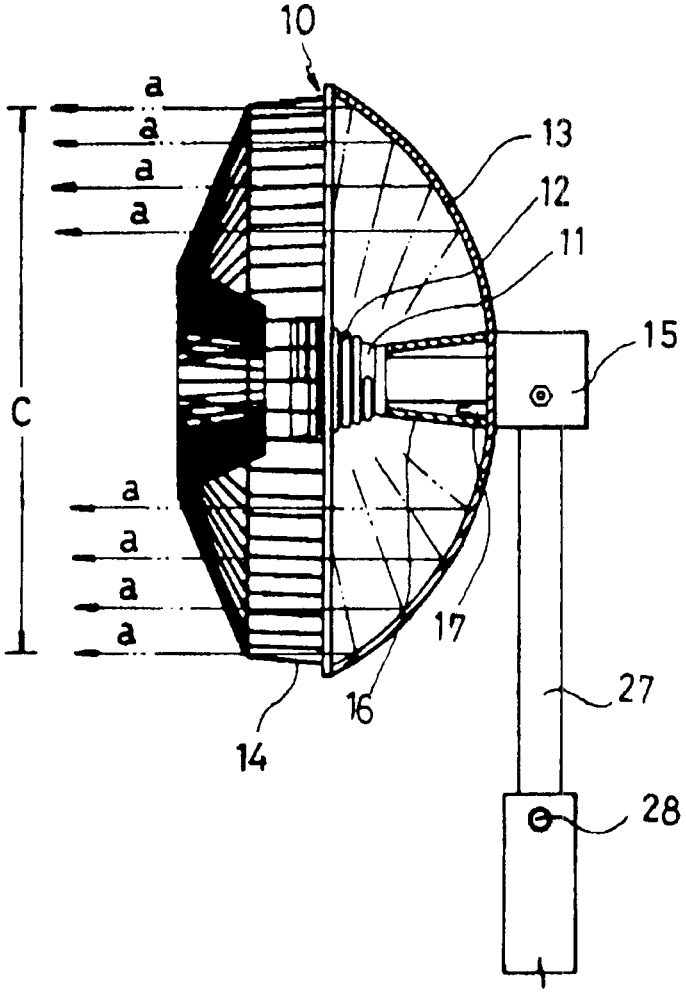
FIG. 2 is an enlarged side sectional view of an essential part of FIG. 1.
Figure 3:
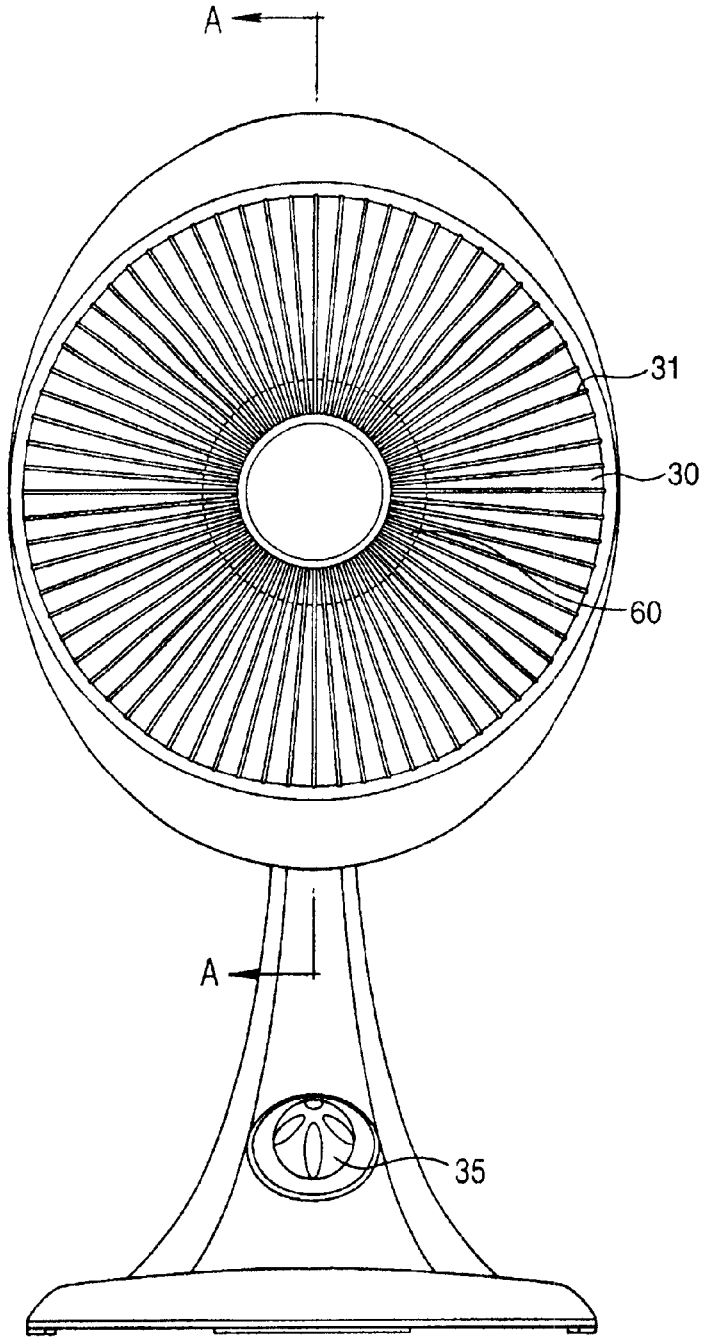
FIG. 3 is a front view of the electric heater according to the present invention.
Figure 4:
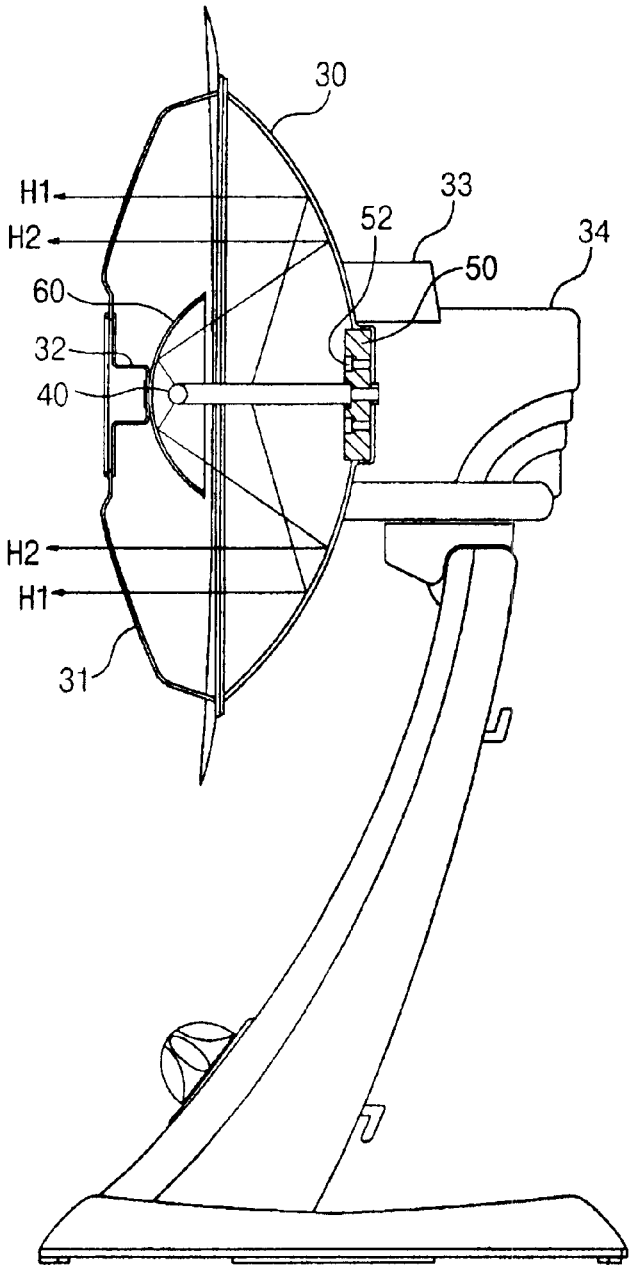
FIG. 4 is a sectional view taken along the line A—A in FIG. 3.
Figure 5:
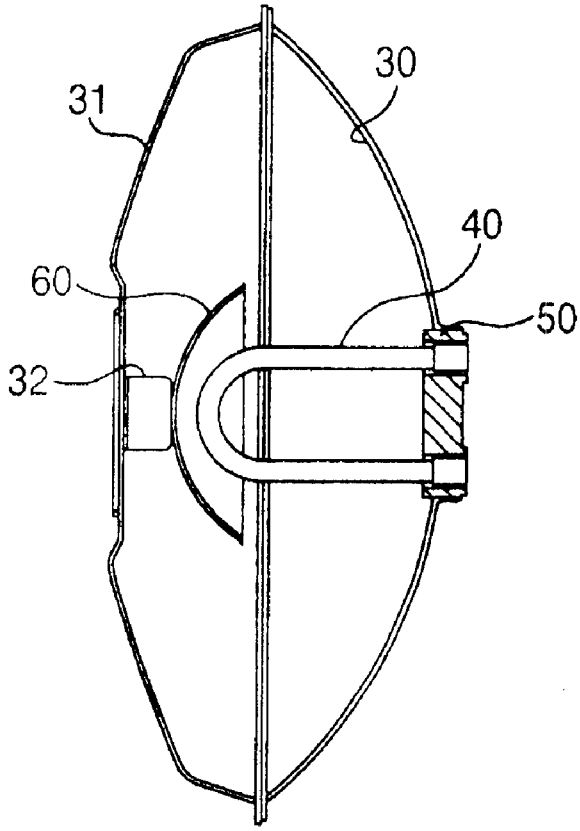
FIG. 5 is a horizontal sectional view of an essential part of FIG. 4.

FIG. 3 is a front view of the electric heater according to the present invention, FIG. 4 is an enlarged sectional view taken along the line A—A in FIG. 3, and FIG. 5 is a horizontal sectional view of an essential part of FIG. 4.

The electric heater of the invention comprises a heating means mounted in a reflecting plate 30, a safety cage 31 disposed in the front surface of the reflecting plate, a halogen lamp fixing plate 50 having a fixing hole 52 to which a halogen lamp 40 is fixed horizontally, a subsidiary reflecting plate 60 disposed in a position corresponding to a central curved portion of the halogen lamp 40 to reflect heat to the reflecting plate 30, and a fixing member 32 interposed between the subsidiary reflecting plate 60 and the center of the safety cage 31 to fix the positions of the plate and the cage. The halogen lamp 40 is fixed to the halogen lamp fixing plate 50 which is prepared from a ceramic material, etc., which insulates the halogen lamp from the reflecting plate 30. It is desirable that the halogen lamp fixing plate 50 is contacted with the reflecting plate 30 so that heat reflection by the reflecting pate 30 cannot be prevented. In FIG. 4, reference numeral 52 indicates a threaded through hole with which screws are driven for combining the halogen lamp fixing plate 50 with the reflecting pate 30, and reference numeral 33 indicates a handle used for transporting the heater. It is desirable that the handle 33 is formed on upper surface of a supporting case 34 which holds the reflecting plate 30 at the rear portion.

The subsidiary reflecting plate 60 is disposed in the front portion of the halogen lamp 40, and a concave portion of the subsidiary reflecting plate 60 is oriented to the reflecting plate 30 to reflect a heat generated from the halogen lamp 40 onto the reflecting plate 30.

In the heater of the present invention having the structure as described above, a screw is driven into the through hole 52 of the halogen lamp fixing plate 50 so that the halogen lamp fixing plate 50 and the reflecting plate 30 are combined with each other by the screws. The halogen lamp 40 is fixed to the halogen lamp fixing plate 50 and then a power cable (not shown) is connected to the halogen lamp 40.

In addition, the fixing member 32 for fixing the reflecting plate is oriented to the reflecting plate 30 and fixed to the central portion of the safety cage 31, and the subsidiary reflecting plate 60 is also fixed to the fixing member 32. In this connection, a concave portion of the subsidiary reflecting plate 60 is oriented to the reflecting plate 30 and the subsidiary reflecting plate 60 is not contacted with a front of the halogen lamp 40.

In the heater of the present invention installed as described above, when a power switch is turned on by an operation of an adjusting knob 35, an electric power is supplied to the halogen lamp 40 so that the halogen lamp generates heat. The reflecting plate 30 reflects some of the heat emitted from the halogen lamp, and then the heat reflected from the reflecting plate 30 (for example, H1) is transferred to the user. Remaining heat emitted from the halogen lamp 40 is first reflected by the subsidiary reflecting plate 60 and then reflected by the reflecting plate 30 so that the heat reflected from the subsidiary reflecting plate 60 and the reflecting plate 30 successively (for example, H2) is also transferred to the user. That is, the heat is reflected by the first reflection only in the conventional electrical heater while the heat of the heater in the present invention is reflected by the reflecting operation including the secondary reflection performed by the subsidiary reflecting plate 60 so that amount of heat reflected is rapidly increased, and thus heating efficiency is relatively enhanced.

In addition, since the subsidiary reflecting plate 60 is installed at the front surface of the halogen lamp 40, a sharp and long apparatus (for example, a chop stick) dealt by the children cannot be contacted directly with the halogen lamp so as to protect the lamp. Also, since the height of the halogen lamp fixing plate 50 is low and the halogen lamp fixing plate 50 is integrally fixed to the reflecting plate 30, installation of the heater is easily and heat transmission can be proceeded without hindrance caused by the fixing plate 50 so that heating efficiency may be enhanced.

According to the present invention as described above, installation of the heating apparatus is easy since the halogen lamp is used as a heating means and is fixed simply to the fixing plate. Also, the lamp can easily be installed even though a size of the fixing plate is small since the fixing plate serves as the fixing plate only.

In addition, since the subsidiary reflecting plate is disposed in the front of the lamp, amount of heat is increased as much as amount of heat reflected from the subsidiary reflecting plate, and thus heating efficiency may be enhanced compared with the prior art heater.

Although this invention has been described in its preferred form with a certain degree of particularity, it is appreciated by those skilled in the art that the present disclosure of the preferred form has been made only by way of example and that numerous changes in the details of the construction, combination, and arrangement of parts may be resorted to without departing. from the spirit and scope of the invention.

What is claimed is:

1. An electric heater comprising:

a halogen lamp mounted in a reflecting plate, a safety cage disposed in front of the reflecting plate, a halogen lamp fixing plate having fixing holes to which the halogen lamp is fixed horizontally, a subsidiary reflecting plate disposed at a position corresponding to a central curved portion of the halogen lamp to reflect heat from the halogen lamp to the reflecting plate; and a fixing member interposed between the subsidiary reflecting plate and the center of the safety cage to fix the position of the subsidiary reflecting plate to the central curved portion of the halogen lamp.

* * * * *

UNITED STATES PATENT AND TRADEMARK OFFICE

CERTIFICATE OF CORRECTION

PATENT NO. : 6,453,121 B2
DATED : September 17, 2002
INVENTOR(S) : Gun-Young Choi It is certified that error appears in the above-identified patent and that said Letters Patent is hereby corrected as shown below:

Title page,
Item [73], Assignee, change "VIC Tech" to -- IC Tech --.

Signed and Sealed this

Twenty-fourth Day of June, 2003

JAMES E. ROGAN
*Director of the United States Patent and Trademark Office*